US009644852B2

(12) United States Patent
Guercio

(10) Patent No.: US 9,644,852 B2
(45) Date of Patent: May 9, 2017

(54) AIR CONDITIONING UNIT

(75) Inventor: Matteo Guercio, Orbassano (IT)

(73) Assignee: CLIMA MOTIVE S.R.L., Sant'Agata Feltria (IT)

( * ) Notice: Subject to any disclaimer, the term of this patent is extended or adjusted under 35 U.S.C. 154(b) by 306 days.

(21) Appl. No.: 14/372,538

(22) PCT Filed: Jan. 20, 2012

(86) PCT No.: PCT/IT2012/000020
§ 371 (c)(1),
(2), (4) Date: Jul. 16, 2014

(87) PCT Pub. No.: WO2013/108276
PCT Pub. Date: Jul. 25, 2013

(65) Prior Publication Data

US 2014/0352344 A1 Dec. 4, 2014

(51) Int. Cl.
*F25B 47/00* (2006.01)
*F24F 1/02* (2011.01)
*F24F 13/22* (2006.01)

(52) U.S. Cl.
CPC ..... *F24F 1/025* (2013.01); *F24F 13/222* (2013.01); *F24F 2013/225* (2013.01); *F24F 2013/227* (2013.01); *F24F 2013/228* (2013.01)

(58) Field of Classification Search
CPC ..... F25D 21/14; F25D 2321/1412
(Continued)

(56) References Cited

U.S. PATENT DOCUMENTS 2,001,309 A * 5/1935 Kelly ..... F24F 1/022 55/430
2,268,846 A * 1/1942 Roper ..... F24F 1/027 165/168

(Continued)

FOREIGN PATENT DOCUMENTS

CN 2058968 U 7/1990
CN 2373703 Y 4/2000

(Continued)

OTHER PUBLICATIONS

International Search Report and Written Opinion dated Nov. 6, 2012 issued in PCT/IT2012/000020.

(Continued)

*Primary Examiner* — Melvin Jones
(74) *Attorney, Agent, or Firm* — Scully, Scott, Murphy & Presser, P.C.

(57) ABSTRACT

An air conditioning unit, which can be located in an enclosed environment comprising at least one duct through which a heat transfer fluid flows. The duct is affected sequentially by at least one compressor, for raising the temperature and pressure of the heat transfer fluid in the gaseous state, at least one condenser, for carrying off heat from the heat transfer fluid and its passage from the gaseous state to the liquid state, at least one lamination element, for lowering the pressure of the heat transfer fluid in the liquid state, and at least one evaporator, for absorbing heat by means of the passage of the heat transfer fluid from the liquid state to the gaseous state.

The air conditioning unit comprises elements of natural, not forced, collection and conveyance, toward the condenser, of condensed water which may have formed along the outer surfaces of the evaporator.

16 Claims, 7 Drawing Sheets

(58) Field of Classification Search
USPC ..... 62/279, 280, 499, 428, 419, 90
See application file for complete search history.

(56) References Cited

U.S. PATENT DOCUMENTS

| | | | | |
|---|---|---|---|---|
| 4,248,057 | A | 2/1981 | Yaguchi | |
| 4,424,686 | A | 1/1984 | Lapeyre et al. | |
| 4,481,788 | A * | 11/1984 | Yoshino | F24D 17/02 236/91 C |
| 6,354,101 | B1 | 3/2002 | Levitin et al. | |

FOREIGN PATENT DOCUMENTS

| | | | |
|---|---|---|---|
| CN | 1587830 | A | 3/2005 |
| EP | 0916905 | A2 | 5/1999 |
| EP | 1909043 | A2 | 4/2008 |
| JP | 5-203186 | | 8/1993 |
| WO | WO 2008/024102 | A1 | 2/2008 |
| WO | WO 2009/148203 | A2 | 12/2009 |

OTHER PUBLICATIONS

Chinese Examination Report dated Jun. 17, 2016 received in Chinese Application No. 201280066417.7, together with a partial English-language brief summarization translation.

* cited by examiner

AIR CONDITIONING UNIT

The present invention relates to an air conditioning unit.

As is known, the need to ensure optimal conditions of temperature and humidity of the air is nowadays felt very strongly in many enclosed environments and for the most varied applications. In fact, the reaching and maintaining of specific values of temperature and relative humidity is often required to ensure the preservation of foodstuffs, the operation of electronic devices, and, especially, for the well-being of individuals who spend more or less prolonged periods of time within enclosed environments, both domestic and public/work-related.

With specific reference to this last need, the use of air conditioning devices is likewise known for motor vehicles such as trucks, caravans (and, sometimes, automobiles as well) and/or for vessels and the like, which enable the control and adjustment of the inner temperature and of the relative humidity of the respective compartments, cabins or other spaces intended to accommodate one or more individuals for extended periods, even with the engine switched off.

Such implementation solutions are not devoid of drawbacks, however.

The air conditioning devices available on the market in fact necessitate, in order to be used, a preliminary installation activity which is often long and difficult. Such activity involves the fixing of an external unit and of an internal unit, the placement and the passage of connection tubes and/or cabling, the preparation of accessories such as condensate pumps, reversing valves (for passing from summer operation mode to winter operation mode, and vice versa), etc., and this makes the use of the devices highly inconvenient.

Moreover, it is the very complexity of the installation operations that makes it substantially impossible, or at least arduous, to transfer such a device in a short time from one motor vehicle (or in any case from an environment of any type) to another, as a consequence determining an unwanted limitation to its possible applications.

The aim of the present invention is to solve the above-mentioned problems, by providing an air conditioning unit that can be installed and used in a practical and easy manner, particularly in compartments, cabins, or spaces of motor vehicles, vessels, and the like.

Within this aim, an object of the invention is to provide an air conditioning unit that can be easily transported and transferred from one environment to another.

Another object of the invention is to provide an air conditioning unit the encumbrance of which is extremely contained.

Another object of the invention is to provide an air conditioning unit that requires a minimal use of accessories.

Another object of the invention is to provide an air conditioning unit that can be easily installed in motor vehicles, vessels, and the like, without the necessity of making modifications to them.

Another object of the invention is to provide a unit that can be used both for heating and for cooling an environment, in a practical and easy manner.

Another object of the invention is to provide a unit that ensures a high reliability of operation.

Another object of the invention is to provide a unit that can be easily implemented using elements and materials that are readily available on the market.

Another object of the invention is to provide a unit that is low-cost and safely applied.

This aim and these and other objects which will become more apparent hereinafter are achieved by an air conditioning unit, which can be arranged in an enclosed environment to modify the temperature levels, relative humidity, and the like, comprising at least one duct through which a heat transfer fluid flows, affected sequentially by at least one compressor, for raising the temperature and pressure of the heat transfer fluid in the gaseous state, by at least one condenser, for carrying off heat from the heat transfer fluid and its passage from the gaseous state to the liquid state, by at least one lamination element, for lowering the pressure of the heat transfer fluid in the liquid state, and by at least one evaporator, for absorbing heat by way of the passage of the heat transfer fluid from the liquid state to the gaseous state, characterized in that it comprises means of natural, not forced, collection and conveyance, toward said condenser, of condensed water which may have formed along the outer surfaces of said evaporator, for the evaporation thereof by means of the heat carried off from the heat transfer fluid.

Further characteristics and advantages of the invention will become more apparent from the description of a preferred, but not exclusive, embodiment of the unit according to the invention, which is illustrated by way of non-limiting example in the accompanying drawings wherein.

Figure 1:
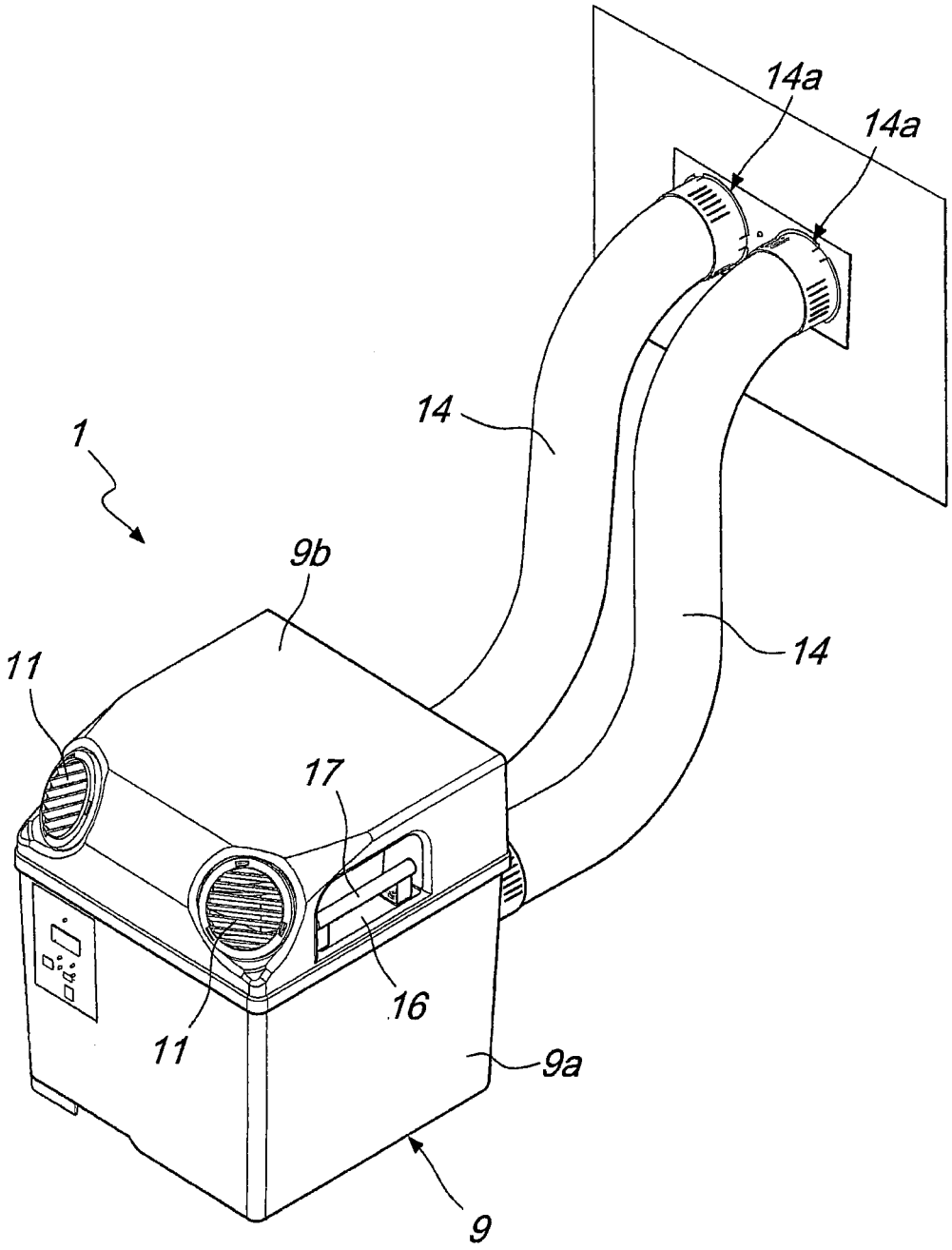
FIG. 1 is a front lateral perspective view of the unit according to the invention.
Figure 2:
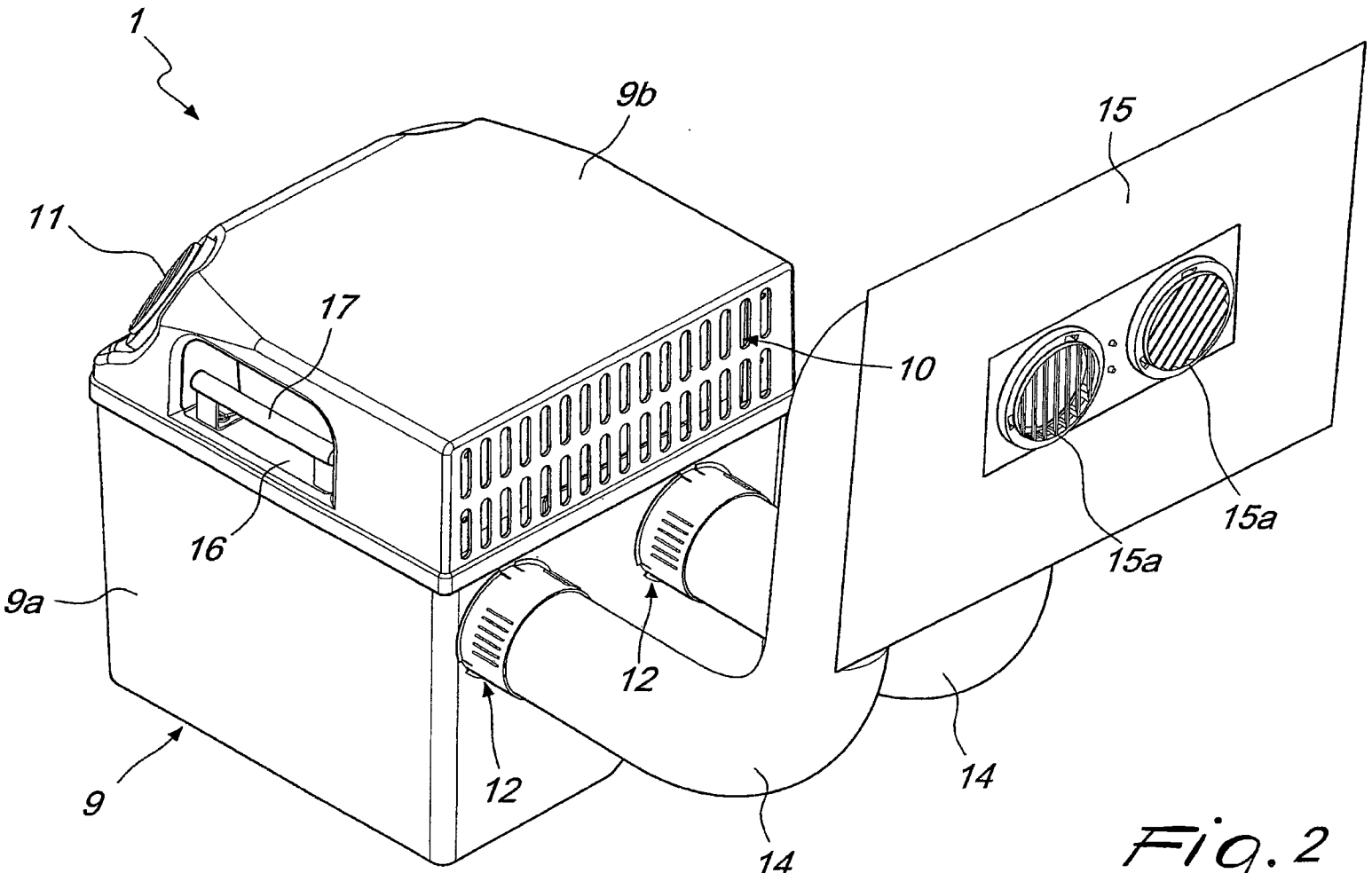
FIG. 2 is a rear lateral perspective view of the unit according to the invention.
Figure 3:
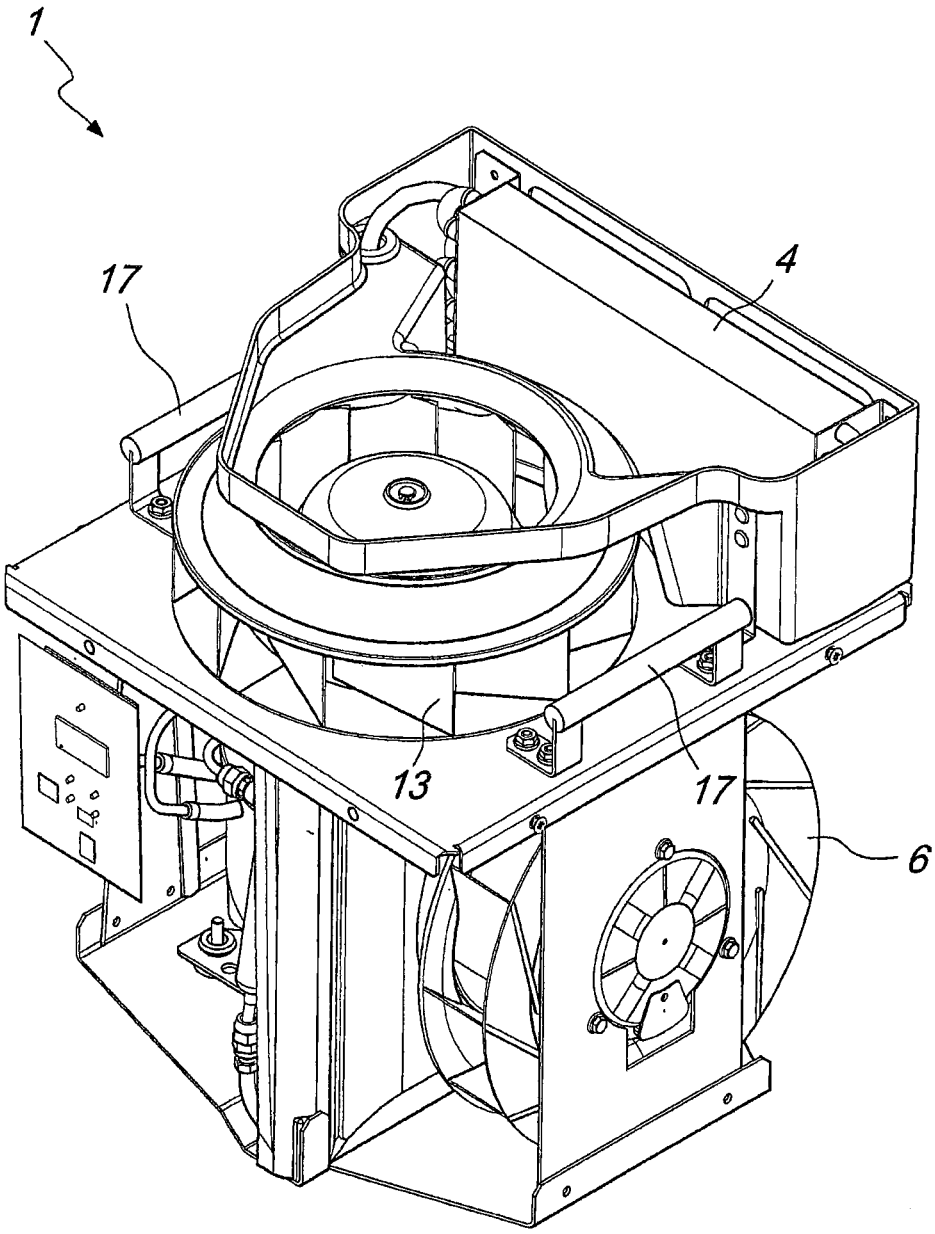
FIG. 3 is a front lateral perspective view of the internal elements of the unit according to the invention.
Figure 4:
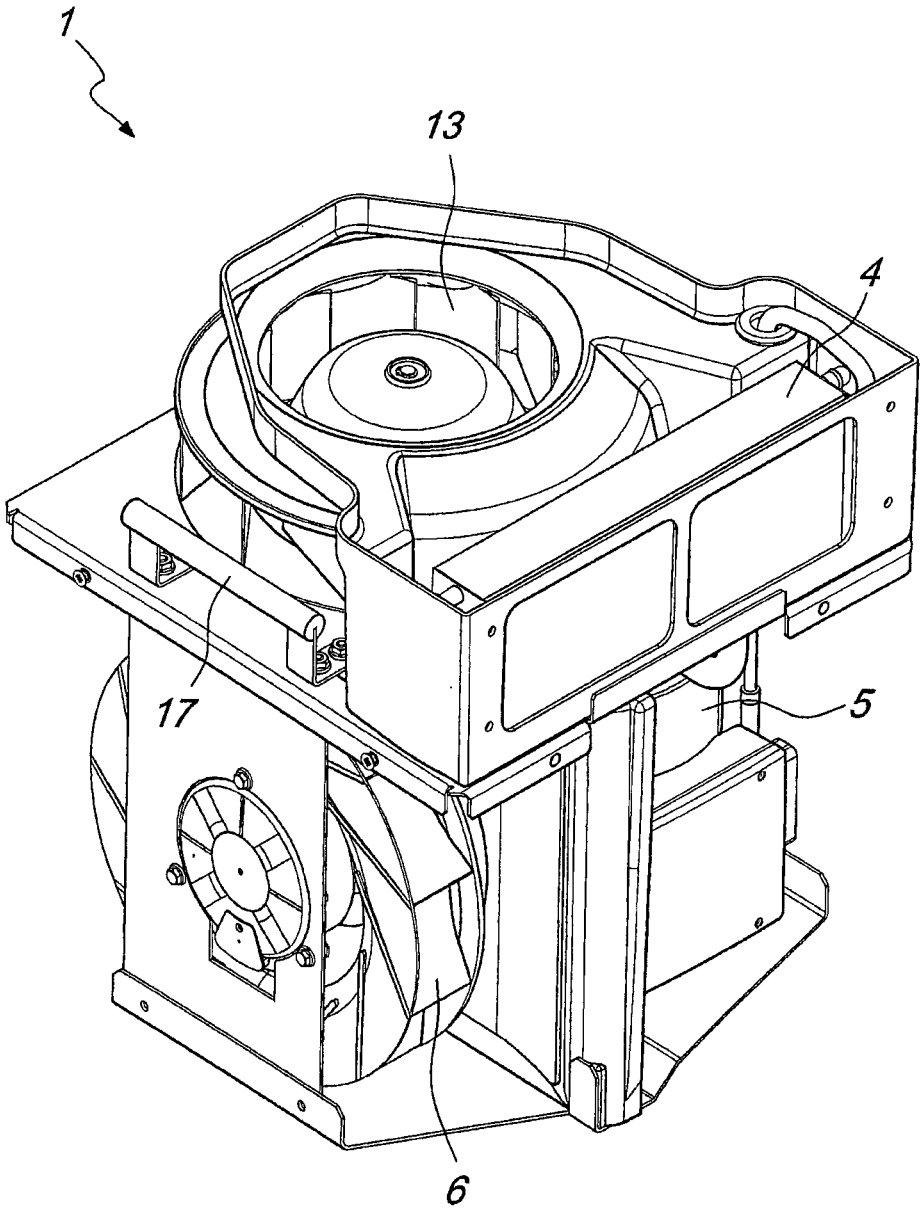
FIG. 4 is a rear lateral perspective view of the internal elements of the unit according to the invention.
Figure 5:
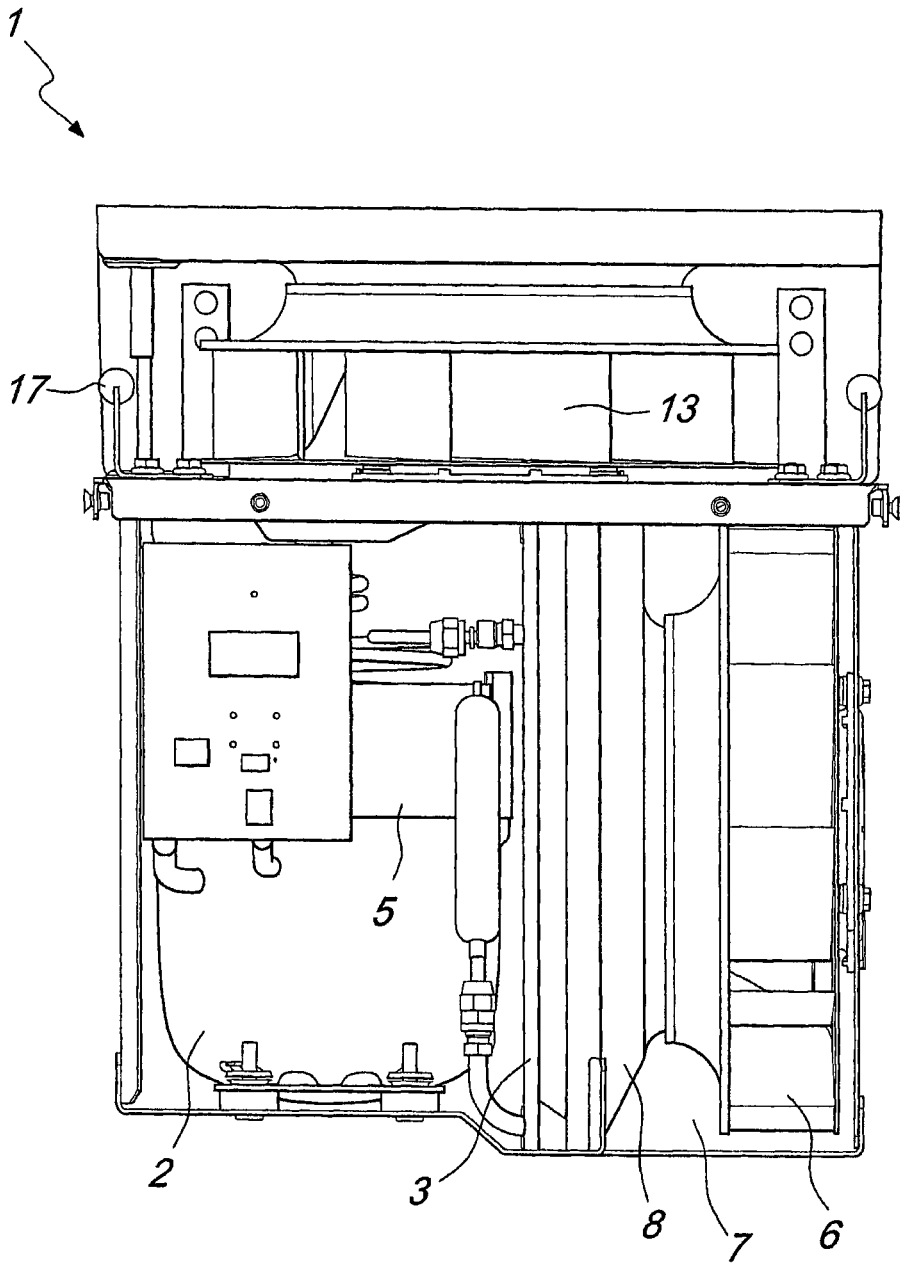
FIG. 5 is a front view of the internal elements of the unit according to the invention.
Figure 6:
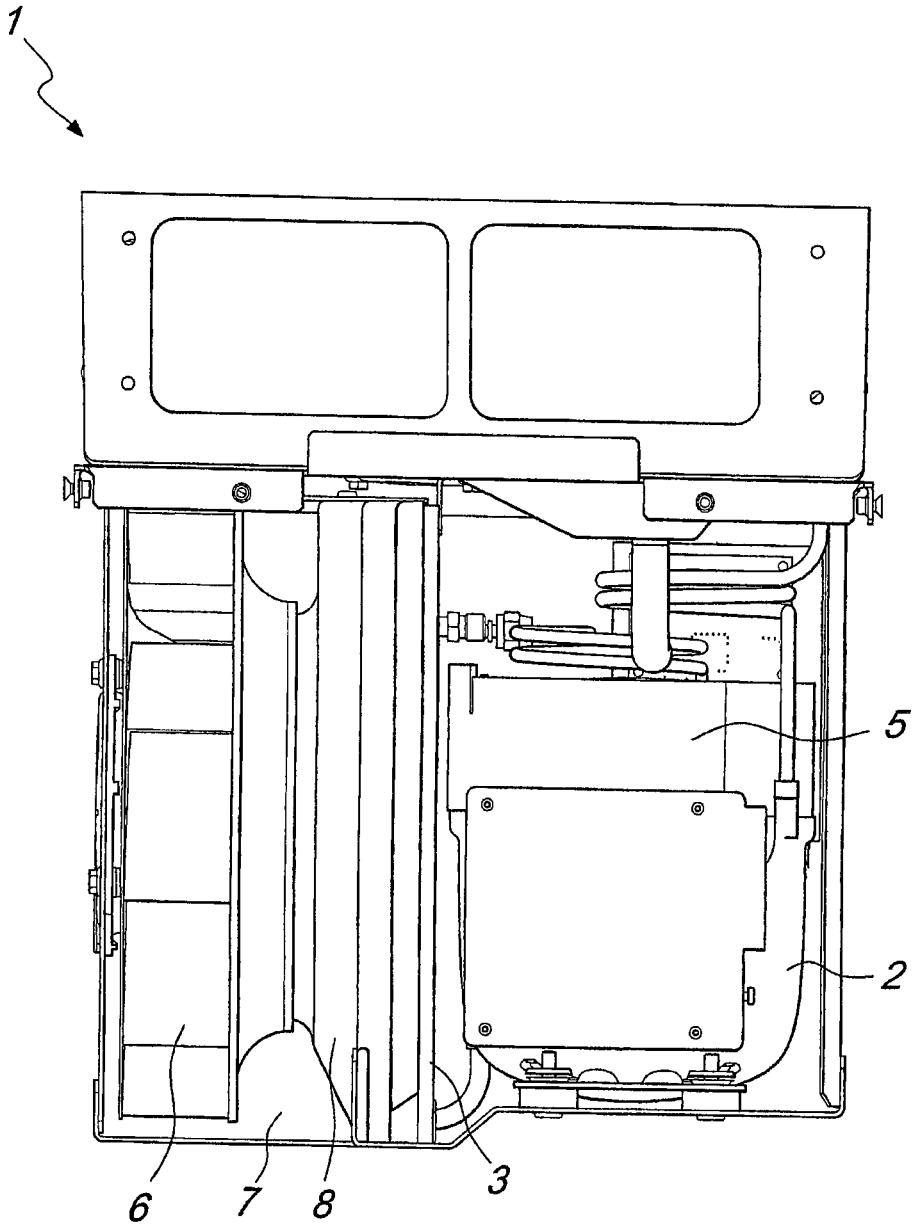
FIG. 6 is a rear view of the internal elements of the unit according to the invention.

With reference to the figures, a unit according to the invention, generally designated with the reference numeral 1, is adapted to the conditioning of air to be heated or air to be cooled (or other fluids), and can therefore be located in an enclosed environment A for the modification of values of temperature, relative humidity, and the like, of the latter.

It should be noted that from this point onward in this discussion a number of possible examples of application of the unit 1 will be given, and thus some types of enclosed environments A to which the unit 1 can be applied, but the possibility is not ruled out of using the unit 1 according to the invention for any enclosed environment A, as a function of specific requirements.

The unit 1 comprises at least one duct through which a heat transfer fluid flows, and which is affected in sequence by a compressor 2, by a condenser 3, by a lamination element and by an evaporator 4, and thus capable of making the heat transfer fluid perform a cooling cycle.

According to methods that are thus substantially known, the compressor 2 is able to raise the temperature and the pressure of the heat transfer fluid in the gaseous state, from which heat is carried off from in the condenser 3 (yielded to a fluid, for example air, to be heated), thus determining the passage thereof from the gaseous state to the liquid state.

Subsequently, in the lamination element, the heat transfer fluid, in the liquid state, expands, with a corresponding lowering of pressure, and finally the heat transfer fluid absorbs heat (carried off from a fluid, for example air, to be cooled) by way of the passage from the liquid state to the gaseous state in the evaporator 4.

According to the invention, the unit 1 comprises means of natural, not forced, collection and conveyance, toward the condenser 3, of condensed water which may form along the outer surfaces of the evaporator 4, for the evaporation thereof by means of the heat carried off from the heat transfer fluid.

As is known in fact, the air to be cooled that strikes the evaporator 4 can undergo a sudden lowering of temperature, such as to cause the formation of droplets of condensation along the outer surfaces of the evaporator 4. The presence of the means introduced above thus makes it possible to evacuate such water, according to the methods that will be described in the pages below, without requiring the adoption of condensate pumps, or other similar accessories, as happens in conventional units.

Conveniently, the above-mentioned means comprise at least one tank 5, which is arranged below the evaporator 4, so as to be able to collect the condensed water (by gravity), and a layer of highly capillar material (for example, but not exclusively, of the type of a sponge, natural or synthetic).

The above-mentioned layer is accommodated partially in the tank 5, so as to be able to impregnate itself with the condensed water that falls from the evaporator 4 above. The layer is moreover provided with at least one end lip that touches the condenser 3, so as to achieve the natural conveyance, by capillary action, of the condensed water toward the condenser 3 and the evaporation thereof by means of the heat carried off from the heat transfer fluid.

Conveniently, the unit 1 comprises a first fan 6, facing the condenser 3, for the forced circulation of a first fluid to be heated (typically, but not exclusively, such first fluid will be air to be heated, as previously mentioned, and it is to this that reference will be made hereinafter in the present discussion) by way of the condenser 3. Moreover, the above-mentioned means comprise a receptacle 7, substantially arranged below the condenser 3 and facing toward the first fan 6. Such receptacle 7, conveniently contoured, is placed in connection (according to various methods, for example by way of respective ducting) with the evaporator 4 for the collection of the condensed water. The condensed water collected in the receptacle 7 can thus be driven against the condenser 3 by the rotation of the first fan 6, by pressure, for the evaporation thereof.

For an optimal evaporation of the condensed water driven by the first fan 6, the condenser 3 is enclosed in an outer housing 8, which is frustum-shaped (and whose axis of symmetry coincides substantially with the rotation axis of the first fan 6). The droplets of condensed water driven by the first fan 6 can thus be distributed along the lateral surface of the housing 8 and, by the heat emitted by the condenser 3 as a result of the passage of the heat transfer fluid from the gaseous state to the liquid state, can then be evacuated outside the unit 1 together with the air, which by now has been heated.

According to the preferred embodiment, cited by way of non-limiting example of the application of the invention, the means of collection and conveyance comprise both the tank 5 and the receptacle 7. It is thus possible first of all to collect the condensed water in the tank 5 to first transport it by capillary action, by way of the layer introduced above, to the condenser 3. The water vapor can then be expelled by way of the first fan 6, while any condensed water that may not have evaporated can be collected in the receptacle 7 (conveniently arranged below the condenser 3), from which, by way of the first fan 6, a second transport to the condenser 3 can be performed, thus ensuring the maximum efficiency in the elimination of the condensed water.

As can be seen from the accompanying figures, the unit 1 according to the invention comprises an outer casing 9, for example composed of a base shell 9*a* closed by a cover 9*b*. Along the casing 9 (and more precisely, along the cover 9*b*) at least one entry port 10 and a pair of air exit ports 11 are provided, facing toward and proximate to the evaporator 4. In this manner, the evaporator 4 is affected by the flow of a second fluid to be cooled (typically, but not exclusively, such second fluid will be air to be cooled, as previously mentioned, and it is to this that reference will be made hereinafter in the present discussion) at the passage of the heat transfer fluid from the liquid state to the gaseous state.

Moreover, the unit 1 comprises a pair of entrances 12, facing toward and proximate to the condenser 3, in order to permit the entry and exit of the air to be heated, at the passage of the heat transfer fluid from the gaseous state to the liquid state.

Advantageously, the unit 1 comprises a second fan 13, accommodated within the casing 9 and substantially interposed between the entry port 10 and the pair of air exit ports 11, in order to force the circulation of the air to be cooled by way of the evaporator 4.

As can be seen from the accompanying figures, the unit 1 moreover comprises a pair of tubes 14, each one of which leads, with a corresponding first free end 14*a*, to the outside of the enclosed environment A. On the opposite side the tubes 14 are selectively associable (for example by snap-fitting) with either the pair of air exit ports 11 or the pair of entrances 12 (as in the example shown in the accompanying figures).

In this manner the user can choose whether to expel the cooled air or the heated air respectively to the outside of the enclosed environment A. In the first case, the heated air (i.e. which has undergone a rise in temperature) circulates within the enclosed environment A, which is thus heated by the unit 1, which operates in winter operation mode, whereas in the second case (shown merely by way of example in the accompanying figures) it is the cooled air that circulates within the enclosed environment A, which is thus in turn cooled, defining the summer operation mode of the unit 1.

Positively, the unit 1 according to the invention comprises an interface plate 15, which can be associated with the edge of an opening B provided along a wall that delimits the enclosed environment A, for the closure thereof. The free ends 14*a* of the tubes 14 are thus fixed to respective slots 15*a* of matching shape provided along the plate 15. The expulsion of the heated air or of the cooled air thus occurs through the slots 15*a* provided along the plate 15, arranged so as to close the opening B.

More specifically, the unit 1 comprises a device for removably attaching the plate 15 to the edge of the opening B. According to a possible embodiment, cited by way of non-limiting example of the application of the invention, the attachment device comprises at least one strip of VELCRO (which is a registered trademark), which is arranged along a preferably perimetric portion of one face of the plate 15, and which can be anchored to a corresponding surface region of the edge of the opening B (which may be provided with a corresponding band, also of VELCRO).

Naturally, the possibility is not excluded of providing the plate 15 with a plurality of strips, arranged along its perimeter, and it is also possible to make use of different attachment devices, without departing from the scope of protection claimed herein.

Conveniently, for reasons that will be made clearer hereinbelow, the plate 15 is made of a transparent material, preferably selected from methacrylate and polycarbonate (and even more preferably it is made from PLEXIGLAS, which is a registered trademark).

The portable air conditioning unit can be placed in any desired enclosed environment A for the modification of values of temperature, relative humidity, and the like, and comprises at least one duct through which a heat transfer fluid flows, affected sequentially by at least one compressor 2, by at least one condenser 3, by at least one lamination element, and by at least one evaporator 4, all operating according to the methods previously explained in the preceding paragraphs, so as to make the heat transfer fluid perform a cooling cycle.

According to the invention, the portable unit 1 comprises means of natural, not forced, collection and conveyance, toward the condenser 3, of condensed water which may have formed along the outer surfaces of the evaporator 4, for the evaporation thereof by means of the heat carried off from the heat transfer fluid.

Conveniently, the portable unit 1 comprises an outer covering casing 9, which is provided with a pair of mutually opposite receptacles 16, capable of accommodating respective handles 17, for transport (from one enclosed environment A to be air-conditioned to another) by a user.

The air conditioning unit can be placed in an enclosed environment A of the type of a compartment, a cabin, an inner space of a motor vehicle, of a vessel and the like, so as to modify its values of temperature, relative humidity, and the like, and comprises at least one duct through which a heat transfer fluid flows, affected sequentially by at least one compressor 2, at least one condenser 3, at least one lamination element and at least one evaporator 4, all operating, as previously noted, so as to make the heat transfer fluid perform a cooling cycle.

According to the invention, the unit 1 comprises means of natural, not forced, collection and conveyance, toward the condenser 3, of condensed water which may have formed along the outer surfaces of the evaporator 4, for the evaporation thereof by means of the heat carried off from the heat transfer fluid.

According to the preferred but not exclusive application of the unit 1 according to the invention, which involves the placement thereof in compartments, cabins etc., the unit 1 comprises an interface plate 15, having a shape and size adapted to the juxtaposition thereof to an opening B of the type of a window of the motor vehicle, of a porthole or of a hatchway of the vessel, and the like, for the closure thereof.

Naturally, in order to enable the use of the unit 1 on different types of motor vehicles or vessels or the like (even of different sizes), it should be noted that the possibility exists of providing the plate 15 with strips of VELCRO (which is a registered trademark), so that, whatever the size of the window, the plate 15 can still be anchored outside it (and more precisely to the inner upholstery of the motor vehicle or of the vessel), along its edge.

The plate 15 is moreover provided with respective slots 15*a* which can be fixed to the free ends 14*a* of a pair of tubes 14. Each one of such tubes 14 is selectively associable on the opposite side with either the condenser 3 or the evaporator 4 (for example according to the methods described on the preceding pages), consequently achieving the corresponding cooling or heating of the enclosed environment A constituted by the compartment or by the cabin.

Figure 7:
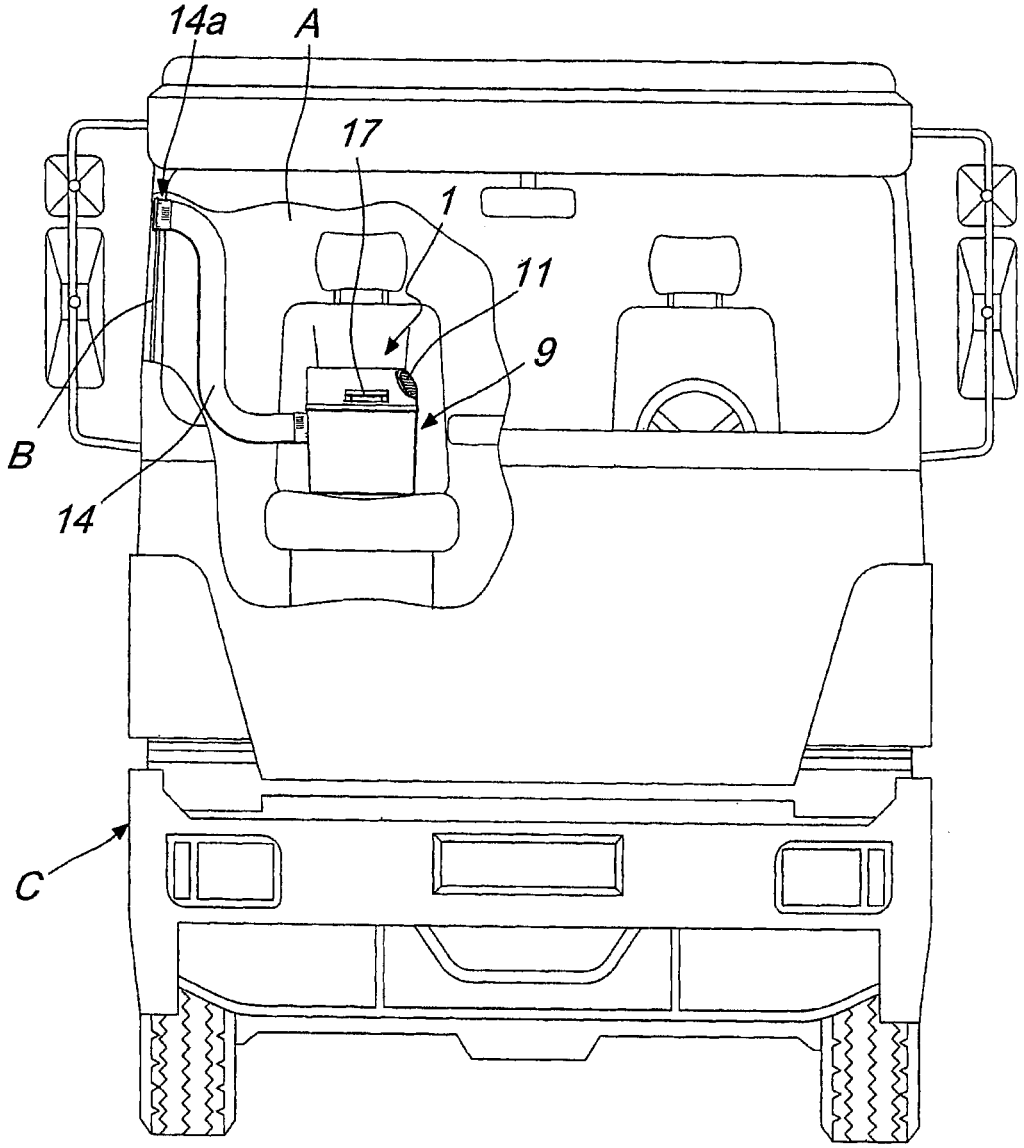
FIG. 7 shows a possible use of the unit according to the invention.

It is useful to note that if the enclosed environment A, in which the unit 1 is placed, is the compartment of a motor vehicle (for example a camper van C, as in the accompanying FIG. 7), it is particularly advantageous to choose to make the plate 15 of PLEXIGLAS (which is a registered trademark) or other transparent material.

In this manner in fact, even with the plate 15 anchored to the edge of the opening B, for the closure thereof, complete visibility is guaranteed to the driver. The plate 15 can thus be kept juxtaposed to the window, even when the unit 1 is not in operation, without disturbing the driver.

The operation of the unit according to the invention is as follows.

Thanks to the cooling cycle performed by the heat transfer fluid, it is possible to cool the second fluid and heat the first fluid, which typically are respectively constituted by air to be cooled and air to be heated that circulates (because it is forced, thanks to the fans 6, 13), within the unit 1, respectively striking the evaporator 4 and the condenser 3.

The unit 1, for example powered by 12V/24V DC (thus with ordinary batteries, without using an endothermic motor), can thus air-condition the enclosed environment A in which it is placed, and more precisely, by choosing whether to connect the tubes 14 to the exit ports 11 or to the entrances 12, it is possible to heat or cool the enclosed environment A, expelling, correspondingly, cooled or heated air to the outside.

In any case, the particular architecture of the unit 1, and more specifically the means of natural collection and conveyance described on the preceding pages, ensure the complete evacuation of the condensed water which may have formed (thanks also to the double sending of this water to the condenser 3), without requiring condensate pumps or other similar accessories, as in conventional air conditioning units.

The presence of the means of conveyance and collection described above makes it possible to effectively avoid the use of condensate pumps, and thus a first component that is always present in conventional air conditioners, and the like, is eliminated.

Moreover, the ability to obtain the heating or the cooling of the compartment, of the cabin, or of another enclosed environment A in which the unit 1 is placed, simply by fixing the tubes 14 to the air exit ports 11 or to the entrances 12, makes it possible to change from winter operation mode to summer operation mode (and naturally vice versa), extremely quickly, without a cycle reversal taking place in the unit 1 (which would lead to major structural complications). The unit 1 according to the invention thus enables the passage from winter operation mode to summer operation mode, and vice versa, without requiring reversing valves (and without wait times in order to pass from cold to hot), thus obtaining the elimination of a second component that is typically present in conventional air conditioners and similar units.

It is thus evident that the unit 1, thanks to the reduced number of components required for its operation, can offer reduced encumbrance and weight and be installed and used in a quick, practical and easy manner, without specific knowledge, with a minimum use of accessories, and can moreover be easily transported and transferred (by gripping it for example at the handles 17), from one enclosed environment A to another.

If moreover it is desired to use the unit 1 for air-conditioning the compartment of a vehicle (and similarly for the cabin of a vessel or the like), it is possible to anchor the plate 15 to the edge of an opening B, in substantial juxtaposition to the respective window, which is thus used for the expulsion of the heated air or of the cooled air to the outside.

The choice to make use of attachment devices of the type of one or more strips of VELCRO (which is a registered trademark) makes it possible to fix the plate 15 to any type of motor vehicle, vessel etc, and thus to install the unit 1, in a practical and easy manner, without requiring holes or modifications of any type to the latter.

In order to enable the expulsion of the heated air or of the cooled air (respectively if the unit 1 is operated for the cooling or for the heating of the compartment) to the outside, it is sufficient to lower, even partially, the window, whereas if the unit 1 is not being used, the user can simply close the window again, and the choice to make the plate 15 of a transparent material makes it possible to keep the latter anchored to the edge of the window, since it does not interfere with complete visibility, required for driving in safety.

In practice it has been found that the unit according to the invention fully achieves the set aim, in that the use of means of natural, not forced, collection and conveyance, toward the condenser, of the condensed water which may have formed along the outer surfaces of the evaporator, makes it possible to obtain the evaporation of the water by means of the heat carried off from the heat transfer fluid and thus makes it possible to provide an air conditioning unit (portable or otherwise) that can be installed and used in a practical and easy manner, particularly, but not exclusively, on compartments, cabins, spaces of motor vehicles, vessels, and the like.

The invention, thus conceived, is susceptible of numerous modifications and variations, all of which are within the scope of the appended claims. Moreover, all the details may be substituted by other, technically equivalent elements.

In the embodiments illustrated, individual characteristics shown in relation to specific examples may in reality be interchanged with other, different characteristics, existing in other embodiments.

In practice, the materials employed, as well as the dimensions, may be any according to requirements and to the state of the art.

The invention claimed is:

1. An air conditioning unit, which can be arranged in an enclosed environment in order to modify a temperature level, and a relative humidity, comprising at least one duct through which a heat transfer fluid flows, affected sequentially by at least one compressor, for raising the temperature and pressure of the heat transfer fluid in the gaseous state, by at least one condenser, for carrying off heat from the heat transfer fluid and its passage from the gaseous state to the liquid state, by at least one lamination element, for lowering the pressure of the heat transfer fluid in the liquid state, and by at least one evaporator, for absorbing heat by means of the passage of the heat transfer fluid from the liquid state to the gaseous state, further comprising means of natural, not forced, collection and conveyance, toward said condenser, of condensed water which may have formed along the outer surfaces of said evaporator, for the evaporation thereof by means of the heat carried off from the heat transfer fluid.

2. The unit according to claim 1, wherein said means of natural, not forced, collection comprise at least one tank, arranged below said evaporator, for the collection of the condensed water, and a layer of highly capillar material, partially accommodated in said tank, for the impregnation thereof with the condensed water collected in said tank, at least one end lip of said layer touching said condenser, for the natural conveyance, by capillary action, of the condensed water toward said condenser and the evaporation thereof by means of the heat carried off from the heat transfer fluid.

3. The unit according to claim 2, wherein said layer is made of a material of the type of a sponge.

4. The unit according to claim 2, further comprising a first fan, facing toward said condenser, for the forced circulation of a first fluid to be heated by way of said condenser, said means of natural, not forced, collection comprising a receptacle, arranged substantially below said condenser and facing toward said first fan, placed in connection with said evaporator for the collection of the condensed water, the rotation of said first fan driving the water collected in said receptacle against said condenser, for the evaporation thereof.

5. The unit according to claim 4, wherein said means of natural, not forced, collection comprise said tank and said receptacle, for the collection of the condensed water in said tank and a first transport thereof by capillary action, by way of said layer, to said condenser, the water that is not evaporated being collected in said receptacle for a second transport to said condenser, by way of said first fan.

6. The unit according to claim 1, further comprising an outer covering casing, along said casing at least one entry port and a pair of air exit ports being defined, facing toward and proximate to said evaporator, respectively for the entry and evacuation of a second fluid to be cooled at the passage of the heat transfer fluid from the liquid state to the gaseous state, and a pair of entrances, facing toward and proximate to said condenser, for the entry and exit of the first fluid to be heated, at the passage of the heat transfer fluid from the gaseous state to the liquid state.

7. The unit according to claim 6, further comprising a second fan, accommodated within said casing and substantially interposed between said entry port and said pair of air exit ports, for the forced circulation of the second fluid to be cooled by way of said evaporator.

8. The unit according to claim 6, further comprising a pair of tubes, each one of said tubes leading, with a corresponding first free end, outside the enclosed environment, on the opposite side said tubes being selectively associable with one of said pair of air exit ports and said pair of entrances, for the expulsion respectively of the second fluid or of the first fluid to the outside of the enclosed environment, and the corresponding heating or cooling of the enclosed environment.

9. The unit according to claim 8, further comprising an interface plate, associable with an edge of an opening provided along a wall delimiting the enclosed environment, for the closure thereof, said free ends of said tubes being fixed to respective slots of matching shape provided along said plate.

10. The unit according to claim 9, further comprising a device for removably attaching said plate to the edge of the opening.

11. The unit according to claim 10, wherein said attachment device comprises at least one strip of VELCRO®, arranged along a preferably perimetric portion of one face of said plate, and anchorable to a corresponding surface region of the edge of the opening.

12. The unit according to claim 9, wherein said plate is made of a transparent material, preferably selected from methacrylate and polycarbonate.

13. A portable air conditioning unit, which can be arranged in an enclosed environment in order to modify a temperature level, and a relative humidity, comprising at least one duct through which a heat transfer fluid flows, affected sequentially by at least one compressor, for raising the temperature and pressure of the heat transfer fluid in the gaseous state, by at least one condenser, for carrying off heat from the heat transfer fluid and its passage from the gaseous state to the liquid state, by at least one lamination element, for lowering the pressure of the heat transfer fluid in the liquid state, and by at least one evaporator, for absorbing heat by means of the passage of the heat transfer fluid from the liquid state to the gaseous state, further comprising means of natural, not forced, collection and conveyance, toward said condenser, of condensed water which may have formed along the outer surfaces of said evaporator, for the evaporation thereof by means of the heat carried off from the heat transfer fluid.

14. The portable unit according to claim 13, further comprising an outer covering casing, provided with a pair of mutually opposite receptacles, for the accommodation of respective handles for transport by a user.

15. An air conditioning unit, which can be arranged in an enclosed environment of the type of a compartment, cabin, or internal space of a motor vehicle, of a vessel, in order to modify a temperature level, and a relative humidity, comprising at least one duct through which a heat transfer fluid flows, affected sequentially by at least one compressor, for raising the temperature and pressure of the heat transfer fluid in the gaseous state, by at least one condenser, for carrying off heat from the heat transfer fluid and its passage from the gaseous state to the liquid state, by at least one lamination element, for lowering the pressure of the heat transfer fluid in the liquid state, and by at least one evaporator, for absorbing heat by means of the passage of the heat transfer fluid from the liquid state to the gaseous state, further comprising means of natural, not forced, collection and conveyance, toward said condenser, of condensed water which may have formed along the outer surfaces of said evaporator, for the evaporation thereof by means of the heat carried off from the heat transfer fluid.

16. The unit according to claim 15, further comprising an interface plate, having a shape and size adapted to a juxtaposition thereof to an opening of the type of a window of the motor vehicle, of a porthole or of a hatchway of the vessel, for the closure thereof, said plate being provided with respective slots that can be fixed to the free end of a pair of tubes, on the opposite side said tubes being selectively associable with either said condenser or said evaporator, and the corresponding cooling or heating of the enclosed environment.

* * * * *